United States Patent [19]

Bauer et al.

[11] Patent Number: 4,960,248

[45] Date of Patent: Oct. 2, 1990

[54] APPARATUS AND METHOD FOR DISPENSING TOWELING

[75] Inventors: Albert H. Bauer, Orlando; Daniel C. Shaw, Geneva, both of Fla.

[73] Assignee: Bauer Industries, Inc., Orlando, Fla.

[21] Appl. No.: 324,092

[22] Filed: Mar. 16, 1989

[51] Int. Cl.[5] ..... B65H 16/02; B65H 16/06

[52] U.S. Cl. ..... 242/55.53; 242/55.2; 242/67.3 R

[58] Field of Search ..... 242/55.2, 55.3, 55.53, 242/67.2, 67.3; 312/37, 38, 39; 4/662, 623, 302, 313, DIG. 3

[56] References Cited

U.S. PATENT DOCUMENTS

| | | | |
|---|---|---|---|
| 3,167,367 | 1/1965 | Rozlog et al. | 312/39 |
| 3,306,548 | 2/1967 | Polder | 242/67.3 |
| 3,737,087 | 6/1973 | Rooklyn | 226/110 |
| 3,797,902 | 3/1974 | Schnyder et al. | 312/39 |
| 3,826,548 | 7/1974 | Schnyder et al. | 312/38 |
| 3,951,485 | 4/1976 | Schnyder et al. | 312/38 |
| 4,141,091 | 2/1979 | Pulvari | 21/313 |
| 4,270,818 | 6/1981 | McCabe | 312/38 |
| 4,403,748 | 9/1983 | Cornell | 242/55.53 |
| 4,573,750 | 3/1986 | Golby | 312/38 |
| 4,666,099 | 5/1987 | Hoffman et al. | 242/55.53 |
| 4,757,337 | 6/1988 | Shikaumi | 354/266 |

FOREIGN PATENT DOCUMENTS

| | | | |
|---|---|---|---|
| 2144101 | 2/1985 | United Kingdom | 312/38 |

OTHER PUBLICATIONS

Eltec Instruments, Inc., 1984, 40623 Single Element Pyroelectic IR Detector with Source Follower.

*Primary Examiner*—Daniel P. Stodola
*Assistant Examiner*—J. Rhoa
*Attorney, Agent, or Firm*—Shlesinger & Meyers

[57] ABSTRACT

A dispenser for roll toweling and the like includes a housing having an aperture. A roll of toweling is rotatably mounted within the housing, a drive system cooperates with the roll for causing the roll to rotate so that toweling is dispensed through the aperture. A non-contact passive sense system is operably associated with the drive system for monitoring that portion of the infrared spectrum associated with animate bodies so that the presence of an animate body may be detected, and for causing selective operation of the drive system upon the animate body being detected.

24 Claims, 3 Drawing Sheets

APPARATUS AND METHOD FOR DISPENSING TOWELING

BACKGROUND OF THE INVENTION

Paper toweling or like continuous absorbent material is normally wound onto a roll for storage prior to use. Numerous dispensers for storing and causing toweling to be dispensed are known. These dispensers typically require the user to actuate a mechanism for causing the roll to unwind and thereby dispense toweling.

The control of infectious disease has increased in importance recently. This is particularly true in hospitals and other medical facilities. Contact with the operating lever of a paper towel dispenser can result in the operating lever becoming contaminated, thereby permitting the infection to be spread to subsequent users. Avoidance of contact with the operating lever is not possible, however, if toweling is to be dispensed.

Active infrared sensors have been disclosed as being useful in causing operation of a paper towel dispenser. An active infrared sensor requires an infrared emitting element for generating the beam and a sensor for measuring reflected beam energy. Such a sensor is not capable, however, of differentiating between animate and inanimate objects.

Those skilled in the art will understand that there is a need for a toweling dispenser which is operated when an electronic sensor detects the presence of an animate body requiring toweling. Differentiation between animate and inanimate bodies prevents unnecessary dispensing of toweling, such as could be caused if some article was placed adjacent or proximate an active infrared sensor. Animate bodies generate infrared radiation of a unique frequency range. The disclosed invention utilizes a passive infrared sensor which monitors for energy within that range as a means for differentiating between animate and inanimate bodies.

OBJECTS AND SUMMARY OF THE INVENTION

The primary object of the disclosed invention is a paper towel dispenser which is operated by a passive infrared sensor monitoring the infrared range unique to animate bodies.

A further object of the disclosed invention is a method for dispensing toweling through the monitoring of infrared radiation unique to animate bodies.

A dispenser for roll toweling and the like comprises a housing having an aperture and means within said housing for rotatably mounting a roll of toweling. Means are also within the housing for causing the roll to rotate, so that toweling is dispensed through the aperture. A non-contact sense means is operable associated with the causing means for monitoring that portion of the infrared spectrum associated with animate bodies, so that the presence of an animate body may be detected. The sense means causes selective operation of the causing means upon the animate body being detected.

A roll towel dispenser according to the invention comprises a housing including top, bottom, front and oppositely disposed laterally spaced side walls. A first aperture is disposed in the front wall intermediate the top and bottom walls and the side walls, and a second aperture is disposed in the front wall intermediate the first aperture and one of the side walls and the bottom wall. A roll of toweling is provided, and means are positioned within the housing proximate the top wall for rotatably mounting the roll of toweling. Passive sense means are mounted to the front wall within the housing and include a lens mounted within the second aperture for permitting radiant energy to pass therethrough, and further including means responsive to received radiant energy of a frequency associated with animate bodies for detecting the presence thereof. Means are operably associated with one of the side walls and disposed proximate the front wall and intermediate the first aperture and the roll of toweling and operably associated with the roll of toweling and the sense mean for causing the roll of toweling to be rotated, and thereby toweling to be dispensed through the first aperture upon an animate body being detected.

The method of dispensing roll toweling comprises the steps of providing an apertured housing in which a roll of toweling is rotatably suspended and the housing includes means operably associated with the roll for causing rotation thereof and thereby toweling to be dispensed through the aperture. Radiant energy of a wavelength associated with animate bodies is monitored, and the rotation causing means operates when an animate body is detected.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DETAILED DESCRIPTION OF THE INVENTION

Figure 2:
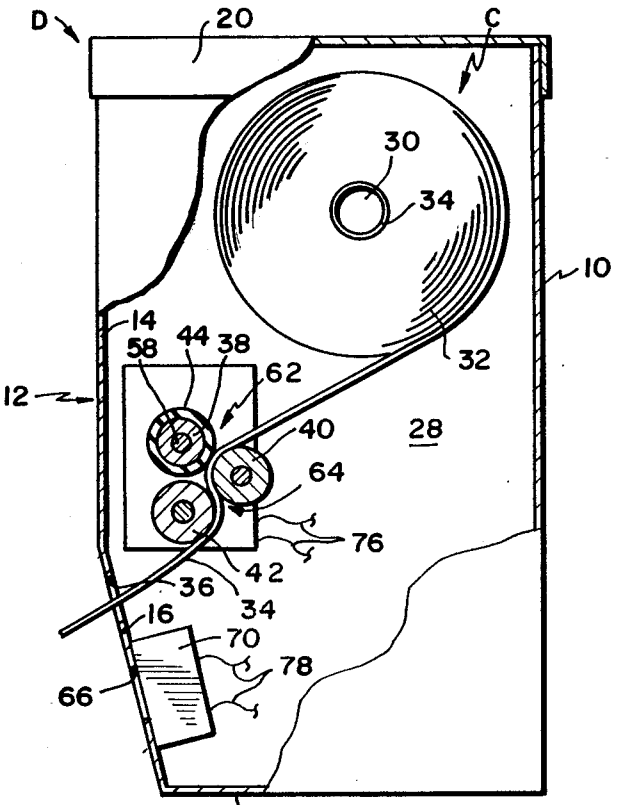
FIG. 2 is a side elevational view with portions broken away and in section.
Figure 1:
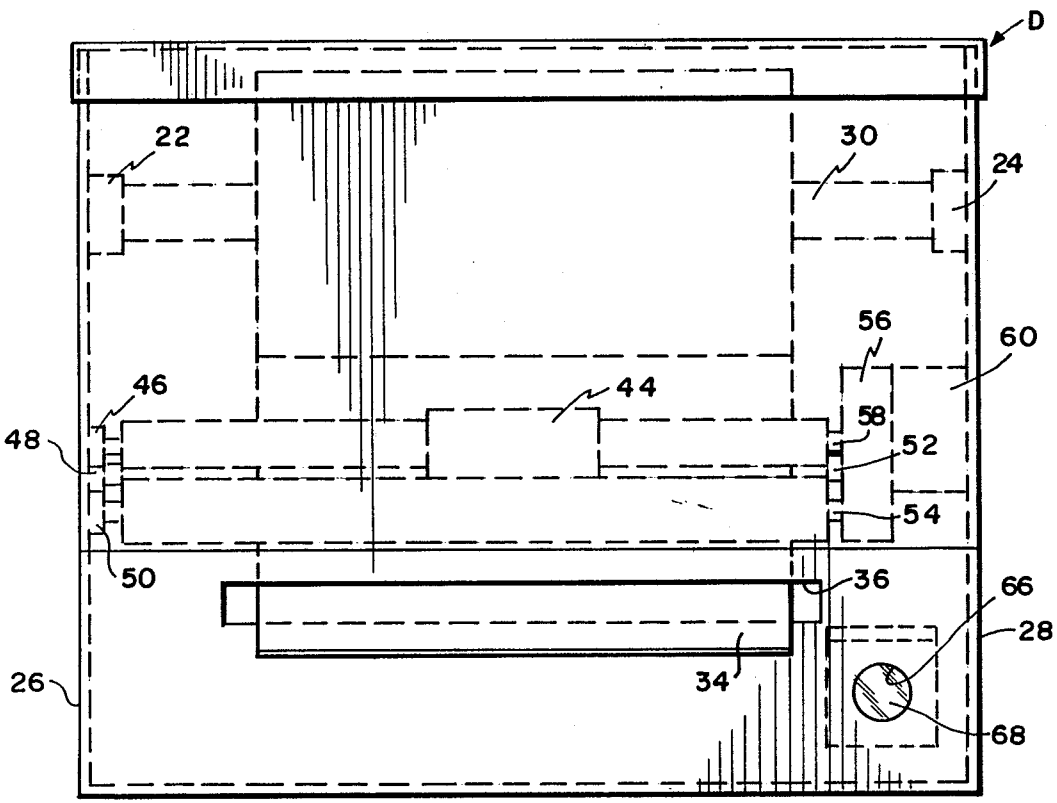
FIG. 1 is an elevational view with portions shown in phantom.

Dispenser D, as best shown in FIGS. 1 and 2, comprises a housing formed of metal, plastic or the like. The housing has a rear wall 10 for being affixed to a wall or like support surface, a front wall 12 comprising a vertical portion 14 and a downwardly directed integral portion 16, as well as bottom wall portion 18 and a removable cover member 20. The housing defines a chamber C in which the operating components of the dispenser D are mounted.

Bearing members 22 and 24 are mounted to side walls 26 and 28, respectively, and rotatably support spindle 30. Roll of toweling 32, as best shown in FIG. 2, has a cardboard sleeve 34 mounted to spindle 30 and rotatable therewith. The roll of toweling 32 is comprised of a continuous length of absorbent material, such as paper towel or the like, which may be periodically perforated for separation. A length 34 of the roll of toweling 32 extends from the roll 32 through opening 36 in front wall portion 16. The opening 36 may have serrated teeth for severing the length 34.

Rollers 38, 40 and 42 are mounted within the chamber C in spaced parallel relation, and are adapted for rotating on mutually parallel axes. The roller 38 has central contact roller 44 mounted thereto and in engagement with roller 40 via length 34. The contact roller 44 is comprised of rubber or like material for providing non-slip engagement with length 34 and indirectly with roller 40. The contact roller 44 is positioned centrally on roller 38, and has a length substantially less than the length of roller 38.

Bearing assemblies 46, 48 and 50 are mounted to side wall 26 for rotatably supporting one end of the rollers 38, 40 and 42, respectively. Like bearing assemblies 52 and 54 are mounted to one way transmission 56 for rotatably supporting the other end of rollers 40 and 42 thereon. Roller 38 has the spindle 58 thereof operably connected to the output shaft of transmission 56. Operation of the transmission 56 by electric motor 60 causes rotation of the roller 38, and thereby of contact roller 44.

The rollers 44, 40 and 42 define nips 62 and 64 through which the length 34 passes while being advanced through opening 36. The first nip 62 is defined by the contact roller 44 and the driven roller 40, and has a gap dimension slightly less than the thickness of the material comprising the length 34. The second nip 64 is defined by the idler roller 42 and the driven roller 40, and is likewise of a gap dimension slightly less than the thickness of the material.

The contact roller 44 engages the length 34 in the nip 62 and drives roller 42. Rotation of roller 38 therefore causes the contact roller 44 and the driven roller 40 to rotate with the result that the portion 34 is pushed through the nip 62. A similar effect is provided by the engagement of the idler roller 42 with the portion 34 in the nip 64, which causes the portion 34 to be pulled through nip 64. The overall result is that the material 34 is pulled from the roll 32 and advanced in a push/pull manner through the nips 62 and 64 toward the aperture 36. We position roll 32 above motor 60 and rolls 38, 40 and 42 above aperture 36, in order to permit easier advancement toward aperture 36. The toweling moves essentially in a straight line, and this minimizes tearing, particularly with perforated toweling. Also, this orientation facilitates feeding from roll 32, because roller 44 forces the leading edge of a new roll toward the nip 64.

Circular aperture 66 is formed in front wall portion 16 intermediate the end of aperture 36 and side wall 28 and bottom wall 18. Lens 68 is positioned in the aperture 66, and is comprised of a material permitting radiation of selected wavelengths to pass therethrough. We prefer that the lens 68 be comprised of a material which filters out ambient illumination, and permits infrared radiation of a desired frequency range to pass therethrough. The position of aperture 66 prevents the lens 68 from being blocked by toweling issued from the aperture 36.

Non-contact passive sensor system 70 is mounted to front wall portion 16 in operative association with lens 68. The sensor 70 is a passive sensor which detects infrared radiation. We prefer the use of a passive sensor, which does not have an active infrared emitting element, because such sensors can be tuned by filtering to the frequency range associated with animate bodies. Therefore, the passive sensor system 70 can differentiate between an animate body which desires to use the dispenser D, and an inanimate body which could be nothing more than a piece of waste paper blocking the lens 68.

Figure 4:
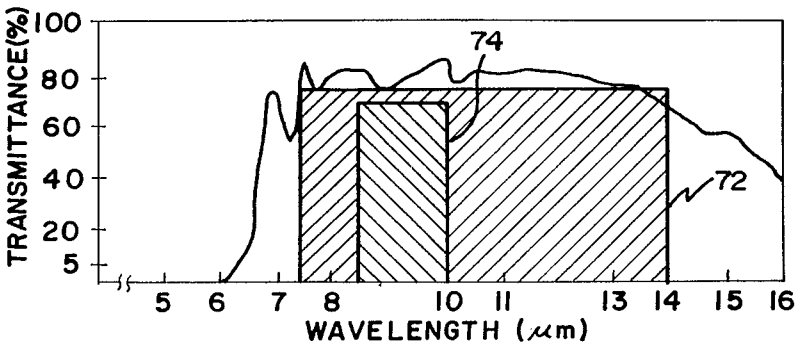
FIG. 4 is a graph disclosing the operating frequency range of the sensor; and, FIG. 5 is a flow chart illustrating the method of operation of the dispenser.

FIG. 4 discloses a graph of transmittance versus wavelength for a sensor useful in the invention. The term transmittance, as used herein, means the radiant power transmitted by a body divided by the total radiant power incident upon the body. Animate bodies give off infrared radiation which has a peak at approximately 10 microns, as best shown in FIG. 4. We monitor the infrared spectrum between 7.5 and 14 $\mu$m, with particular attention in the range of 8.5 to 10 $\mu$m. Radiation of a frequency less than 7.5 $\mu$m or greater than 14 $\mu$m is disregarded, by filter or other means, so that spurious signals can be eliminated. In this way, we are be reasonably certain that the receipt of radiation in the range of 7.5 to 14 $\mu$m is indicative of the presence of an animate body, probably one requiring use of the dispenser D. The box 72 of FIG. 4 represents a 75% transmission average, while the box 74 represents a 70% transmission absolute.

Passive infrared detectors are known in the art, and one which may be used with the dispenser D is Model 40623 sold by Eltec Instruments Inc. That detector is comprised of a lithium tantalate sensing element and a JFET source follower sealed into a transistor housing incorporating an optical filter. Other forms of passive sensors are known, and include those comprising polarized ceramic or polyvinylidene fluoride, such as disclosed in U.S. Pat. No. 4,757,337 of Shikaumi, the disclosure of which is incorporated herein by reference.

We prefer the passive sensor system 70 to an active system, because the sense area is three dimensional and egg shaped. This defines a relatively large target area which is not dependent upon reflection of radiation from an emitter. A user placing a hand in the general proximity of the lens 68 will cause activation of the motor 60, and thereby toweling to be dispensed. The sense system 70 detects the presence of a user by a comparison of the heat given off by the user with a background, such that the sense system 70 is useable when the individual's hand is less than and greater than ambient.

Figure 5:
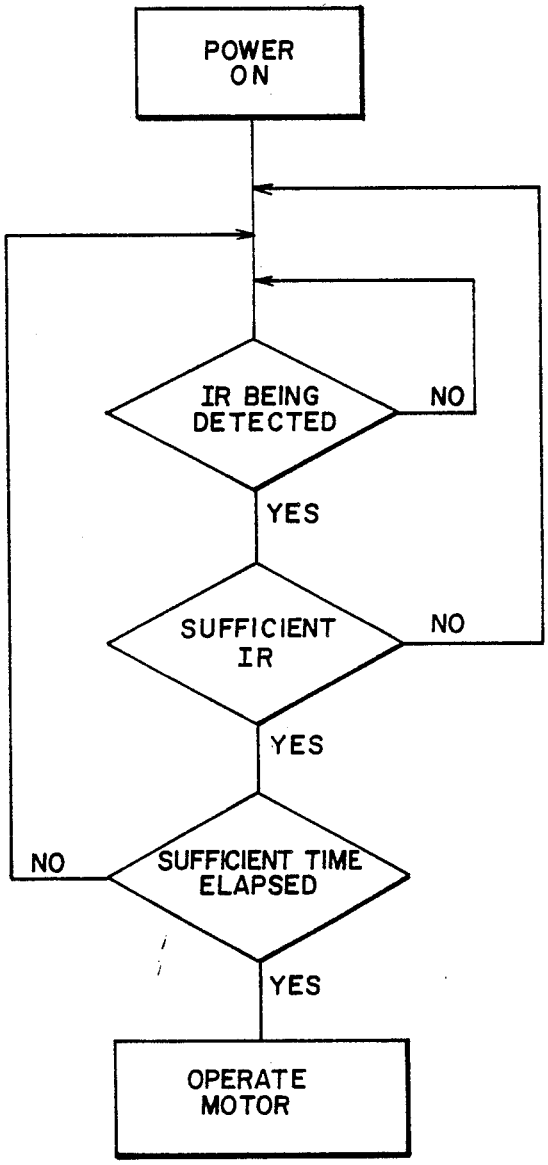

FIG. 5 discloses a flow chart which is used by the dispenser D for determining when the motor 60 should be operated. The system first is actuated, such as by connection of the leads 76 and 78 to a source of power. Next, the sensor system 70 determines whether infrared radiation in the frequency range of interest is being detected. If it is being detected, then the sensor system 70 determines whether it is being detected in sufficient quantity or intensity, thereby indicating whether the user is within the target area. This prevents actuation of the motor 60 by an individual within the general location of dispenser D, but not within the three dimensional egg-shaped target area used by the sensor system 70. We also require that the radiation be emanated from the target zone for a sufficient period, in order to make certain that someone is not just walking by the sensor 70.

Assuming that sufficient infrared radiation is detected, then the system determines whether a sufficient period has elapsed since the motor 60 was last operated. We have found it desirable to incorporate a timer system preventing rapid cyclic operation of dispenser D, such as could occur if a user was to move his or her hand rapidly in front of the lens 68. The timer requires that a sufficient period has elapsed since the previous operation.

Assuming that a sufficient period has elapsed, then the motor 60 is caused to operate. Operation of the motor 60 causes toweling to be dispensed through the aperture 36. We also provide a timer for stopping the motor, in order to limit the quantity of toweling which is dispensed. We prefer that approximately 15 linear inches of toweling be dispensed, and this appears to be a sufficient quantity for a user to dry his or her hands.

Figure 3:
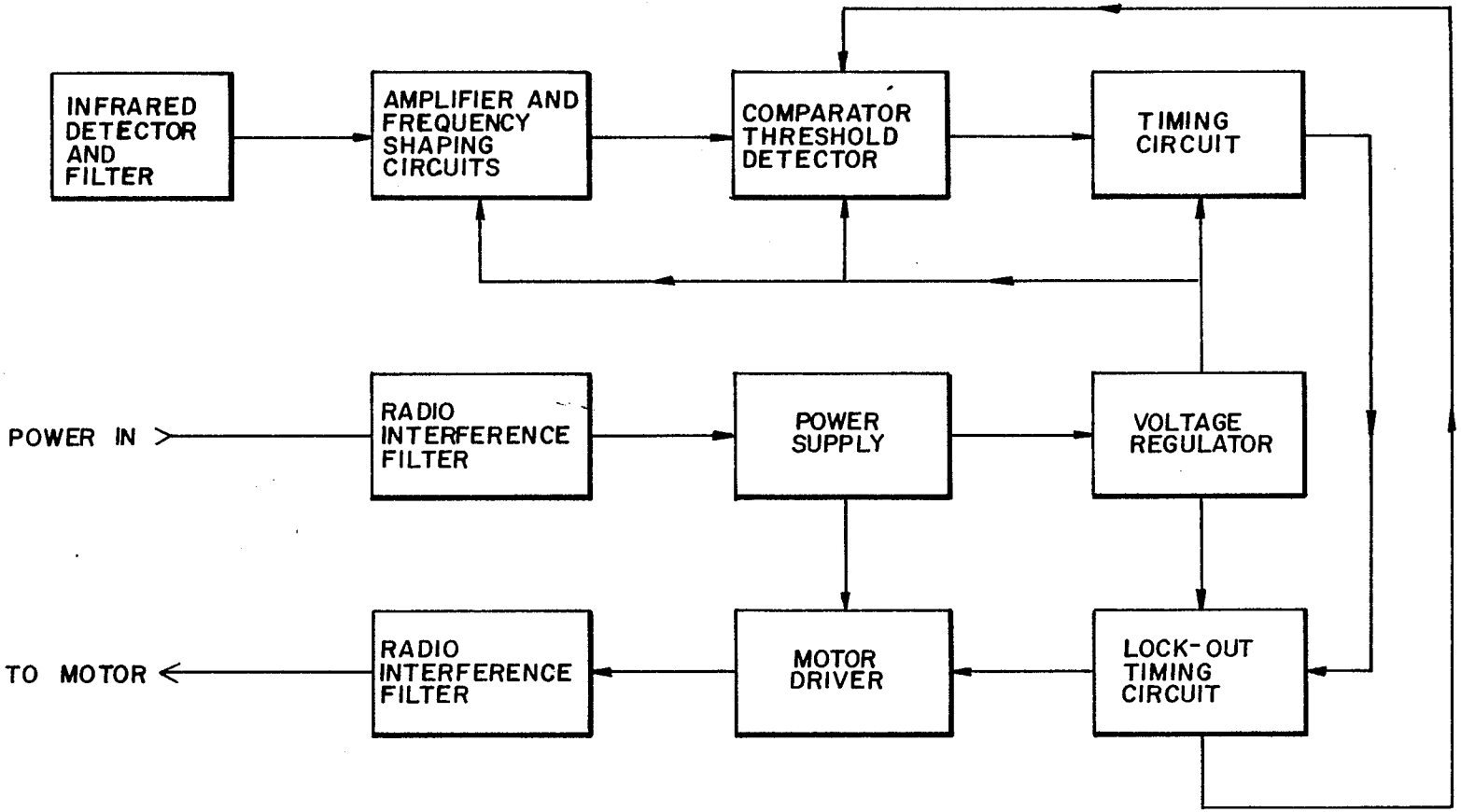
FIG. 3 is a schematic diagram illustrating the circuitry of the dispenser.

FIG. 3 discloses the electrical circuit used for causing operation of the motor 60. A passive infrared detector, such as the Model 40623, has an optical filter for eliminating radiant energy other than in the range of interest, and may be integral with lens 68. The detector transmits a signal to an amplifier and frequency shaping circuit which communicates with comparator threshold detector circuit for making certain that the radiation is of sufficient intensity. A timing circuit then makes certain that the radiation is present in the target area for a sufficient period, in order to minimize the possibility of operation being caused by someone walking quickly past the lens 68. Once the presence of a user has been detected, then the circuitry makes certain that a sufficient period has elapsed since last operation of the motor and, assuming that a sufficient period has elapsed, initiates the motor driver. A radio interference filter is provided to prevent spurious operation of the motor by transient signals emanating from radios, walkie talkies and the like. We also provide a radio interference filter in the power input system for like reason. This assures that spurious signals are not received, and also makes certain that spurious signals are not transmitted to the motor. Naturally, a voltage regulator is provided.

While this invention has been described as having a preferred design, it will be understood that it is capable of further modification, uses and/or adaptations of the invention, following in general the principle of the invention and including such departures from the present disclosure as come within known or customary practice in the art to which this invention pertains, and as may be applied to the central features hereinbefore set forth and fall within the scope of the invention of the limits of the claims.

What we claim is:

1. A dispenser for roll toweling and the like, comprising:

(a) a housing having an aperture;

(b) means with said housing for rotatably mounting a roll of toweling.

(c) means within said housing for causing the roll to rotate so that toweling is dispensed through said aperture;

(d) passive non-emitting sense means operably associated with said causing means for monitoring a pre-selected portion of the infrared spectrum associated with animate bodies so that the presence of an animate body may be detected and for causing selective operation of said causing means upon an animate body being detected; and (e) said passive sense means including a timing circuit means operably connected to said causing means for preventing operation of said causing means unless the pre-selected portion of the infrared spectrum is present for a sufficient period.

2. The dispenser of claim 1, wherein said causing means includes:

(a) first and second juxtaposed rolls rotatable on parallel axes and forming a first nip through which toweling passes; and, (b) a driver roll rotatable on an axis parallel to the axes of said first and second rolls, said driver roll indirectly rotatably engaged with a first one of said first and second rolls for causing rotation thereof and thereby toweling to be transported through said first nip and said driver roll cooperating with said first one of said first and second rolls for forming a second nip therewith and said driver roll engageable with toweling disposed within said second nip so that the toweling is transported therethrough to said first nip.

3. The dispenser of claim 2, wherein:

(a) non-slip means are mounted to said driver roll and are engageable with toweling disposed within said second nip for preventing the toweling from slipping relative to said driver roll.

4. The dispenser of claim 2, wherein:

(a) said second nip is disposed above said first nip.

5. The dispenser of claim 2, wherein:

(a) said driver roll axis is disposed above said first roll axis and said first roll axis is disposed above said second roll axis.

6. The dispenser of claim 5, wherein:

(a) said toweling roll rotatable on an axis parallel to the axes of said first, second and driver rolls.

7. The dispenser of claim 2, wherein said causing means includes:

(a) motor means; and, (b) transmission means having the input thereof operably engaged with said motor means and the output thereof operably engaged with said driver roll so that operation of said motor means causes rotation of said driver roll.

8. The dispenser of claim 7, wherein:

(a) said motor and transmission means are disposed in line with said first, second and driver rolls and above said sense means.

9. The dispenser of claim 8, wherein:

(a) said motor means is operably mounted to a side wall of said housing and said sense means is mounted to a front wall thereof.

10. The dispenser of claim 9, wherein:

(a) said aperture is disposed in said front wall and above said sense means.

11. The dispenser of claim 7, wherein:

(a) each of said first and second rolls has a first end rotatably supported by a side wall of said housing and having a second end rotatably supported by said transmission means.

12. The dispenser of claim 1, wherein:

(a) said sense means monitors the infrared portion of the spectrum between 7.5 and 14 $\mu$m.

13. The dispenser of claim 12, wherein:

(a) said housing has a front wall and said aperture is disposed within said front wall;

(b) said housing includes a second aperture disposed in said front wall below said first mentioned aperture; and, (c) said sense means includes a lens mounted within said second aperture.

14. The dispenser of claim 13, wherein:

(a) said sense means is secured to said front wall; and, (b) the roll of toweling mounted within said housing is disposed above said causing means and said sense means.

15. The dispenser of claim 13, wherein:

(a) said housing includes oppositely disposed first and second side walls;

(b) said first mentioned aperture is disposed intermediate said side walls; and, (c) said lens is disposed intermediate said first mentioned aperture and one of said side walls for preventing said lens from being blocked by dispensed toweling.

16. A roll towel dispenser, comprising:

(a) a housing including top, bottom, front and oppositely disposed laterally spaced side walls;

(b) a first aperture in said front wall intermediate said top and bottom walls and said side walls and a second aperture in said front wall intermediate said first aperture and one of said side walls and said bottom wall;

(c) a roll of toweling;

(d) means within said housing proximate said top wall for rotatably mounting said roll of toweling;

(e) passive non-emitting sense means operably associated with said causing means for monitoring a preselected portion of the infrared spectrum associated with animate bodies so that the presence of an animate body may be detected and for causing selective operation of said causing means upon an animate body being detected;

(f) said passive sense means including a timing circuit means operably connected to said causing means for preventing operation of said causing means unless the pre-selected portion of the infrared spectrum is present for a sufficient period;

(g) said passive sense means being mounted to said front wall within said housing and including a lens mounted within said second aperture for permitting infrared energy to pass therethrough and further including means responsive to received infrared energy of a frequency associated with animate bodies; and, (h) means operably associated with one of said side walls disposed proximate said front wall and intermediate said first aperture and said roll and toweling and operably associated with said roll of toweling and said sense means for causing said roll of toweling to be rotated and thereby toweling dispensed through said first aperture upon an animate body being detected by said sense means.

17. The dispenser of claim 16, wherein:

(a) said passive sense means are responsive to radiant energy of a wavelength of between about 7.5 and about 12.0 $\mu$m.

18. The dispenser of claim 16, wherein said causing means includes:

(a) fist and second juxtaposed parallel rotatable idler rolls forming a first nip and a driver roll indirectly rotatably engaged with said first idler roll for causing rotation thereof and juxtaposed to said first idler roll for forming a second nip therewith;

(b) portions of said toweling are disposed within said first and second nips so that rotation of said driver rolls causes the toweling to be transported through said nips to said first aperture and for simultaneously causing said roll of toweling to be rotated so that toweling is supplied to said nips; and, (c) drive means are operably associated with said driver roll for causing rotation thereof.

19. The dispenser of claim 18, wherein:

(a) said first idler roll is rotatable on a first axis, said second idler roll is rotatable on a second axis disposed below said first axis, and said driver roll is rotatable on a third axis disposed above said first axis.

20. The dispenser of claim 16, wherein:

(a) said means for rotatably mounting are disposed above said means for causing and said means for causing are disposed above said first aperture.

21. The dispenser of claim 20, wherein said means for causing includes:

(a) driver, driven and idler rolls rotatable on parallel axes;

(b) said driver roll is indirectly rotatably engaged with said driven roll for causing rotation thereof; and, (c) drive means are mounted within said housing and are operably engaged with said driver roll for causing rotation thereof.

22. The dispenser of claim 20, wherein:

(a) a first nip is disposed between said driven roll and said idler roll;

(b) a second nip is disposed between said driver roll and said driven roll; and, (c) a portion of said toweling is disposed in said nips.

23. The dispenser of claim 22, wherein:

(a) contact means are mounted to said driver roll for engaging and causing advancement of toweling in said first nip, and said contact means extend a portion of the length of said driver roll.

24. The dispenser of claim 21, wherein said drive means includes:

(a) electric motor means;

(b) transmission means operably associated with said motor means and with said driver roll for causing rotation thereof as said motor means is operated.

* * * * *